US005716200A

United States Patent [19]

Mirumachi et al.

[11] Patent Number: 5,716,200

[45] Date of Patent: Feb. 10, 1998

[54] BLOWER APPARATUS HAVING A CASING AND MOTOR FLANGE HAVING NOISE REDUCING CONFIGURATION

[75] Inventors: Mitsuaki Mirumachi, Hitachinaka; Mitsuo Ujiie, Hitachioota; Yoshinori Fukasaku, Hitachi; Takashi Yokoyama, Hitachinaka, all of Japan

[73] Assignees: Hitachi, Ltd., Tokyo; Hitachi Car Engineering Co., Ltd., Hitachinaka, both of Japan

[21] Appl. No.: 634,206

[22] Filed: Apr. 18, 1996

[30] Foreign Application Priority Data

Apr. 24, 1995 [JP] Japan ..... 7-098458

[51] Int. Cl.[6] ..... F04B 35/04

[52] U.S. Cl. ..... 417/360; 417/423.14; 417/423.15; 417/424.2

[58] Field of Search ..... 417/363, 423.14, 417/423.15, 424.1, 424.2

[56] References Cited

U.S. PATENT DOCUMENTS

| | | | |
|---|---|---|---|
| 3,408,942 | 11/1968 | Davenport et al. | 417/423.14 |
| 5,110,266 | 5/1992 | Toyoshima et al. | 417/423.14 |
| 5,388,970 | 2/1995 | Muckelmann et al. | 417/363 |

FOREIGN PATENT DOCUMENTS

| | | |
|---|---|---|
| 85514 | 6/1988 | Japan . |
| 8638 | 2/1994 | Japan . |

*Primary Examiner*—Charles G. Freay

*Attorney, Agent, or Firm*—Antonelli, Terry, Stout, & Kraus, LLP

[57] ABSTRACT

A motor 2 has a motor flange 6 for supporting the weight of the motor and is installed on a blower casing 5. The motor flange 6 has a dimension in the radial direction of the motor which is smaller than the outer diameter of the fan 1 and extends in the radial direction of the motor 2 from an outer peripheral portion of the motor 2. A motor casing 5 is formed by a flange portion **5*a* having an outside installing portion 5*m* and an inside supporting portion 5*n*, and a cylindrical shaped housing portion 5*b*. The outside installing portion 5*m* has a dimension in the radial direction of the motor which is larger than the outer diameter of the fan 1 and the inside supporting portion 5*n* has a dimension in the radial direction of the motor which is smaller than the outer diameter of the fan 1. The motor 2 is installed on the blower casing 4 through the outside installing portion 5*m* of the motor casing 5. Due to the configuration of the housing portion 5*b*, a space s is formed which establishes a non-contacting condition between the inner peripheral portion of the housing portion 5*b* and the outer peripheral portion of the motor 2, except for the motor flange 6, and the motor 2 is enclosed outside of the blower casing 4 by the housing portion 5*b***.

9 Claims, 5 Drawing Sheets

BLOWER APPARATUS HAVING A CASING AND MOTOR FLANGE HAVING NOISE REDUCING CONFIGURATION

BACKGROUND OF THE INVENTION

The present invention relates to a blower apparatus, and particularly to a blower apparatus suitable for use in automobiles.

In a blower apparatus for use in automobiles, generally a motor is installed on a blower casing through a motor flange for supporting the motor, and the motor is attachably and detachably provided on the blower casing. In a conventional blower apparatus for use in automobiles, this kind of motor flange for supporting the motor and the motor itself are both made of a metal material. The motor flange typically has a dimension which is larger than the outer diameter of the fan driven by the motor and the motor flange is fixed to an outer peripheral portion of the motor housing using a spot welding process, for example.

Recently, it has been suggested that the motor flange of the blower apparatus need not be made of a metal material, as indicated in Japanese utility model laid-open publication No. 85,514/1988, wherein it has been proposed that the motor flange may be integrally formed using a synthetic resin material in association with a receiving portion (motor casing) for forming the motor housing.

Further, as described in Japanese patent laid-open publication No. 8,638/1994, the motor cover for a blower apparatus may be divided into two pieces with both ends of the motor housing being sandwiched by the two divided motor covers, the two divided motor covers being connected to each other through a fastener.

In the above stated conventional techniques for a blower apparatus, wherein a metallic motor flange is employed, the dimension of the motor flange is larger than the outer diameter of the fan so as to make it possible to more easily attach or to detach the motor flange to or from the blower casing. However, it is undesirable to employ a blower apparatus having a metallic motor flange from the aspect of product weight, etc.

Further, since use of a metallic motor flange is inferior from the aspect of providing a complicated shape, it is difficult to provide a complicated air sealing construction. In order to secure an airtight property, it is necessary to provide a separate air sealing member exclusively for this purpose, and so the manufacturing cost of the blower apparatus becomes high.

On the other hand, by using a synthetic resin motor flange instead of a metallic motor flange, it is possible to reduce the overall weight of the blower apparatus. In addition, since it is possible to easily produce a complicated shaped component using a synthetic resin, a complicated shaped air sealing member can be manufactured, whereby the above stated problems can be solved.

However, in connecting and supporting the motor housing to the motor cover and the motor flange, the following problems occur. Namely, a dynamic energy is generated due to a rotational unbalance of the fan and rotor, and this dynamic energy is transmitted as a minute vibration through the bearing member for supporting the rotor to the whole motor housing, which is constituted by a yoke and an end bracket. The vibration is largely generated at an end face of the bearing member on one side (or both sides) of the end bracket for supporting the bearing member and the yoke.

Further, the vibration is transmitted from the contacting portion between the motor housing and the motor casing for covering the motor housing to the motor casing. The vibration is amplified at the motor casing, which has a comparatively large surface area. Thereby, an increase in the sound pressure level at a particular frequency and a variation in the noise level etc. occur. For example, in the blower apparatus shown in Japanese utility model laid-open publication No. 85,514/1988, since the motor housing is inserted under pressure into the resin synthetic motor casing, the vibration from the motor housing is easily transmitted to the resin synthetic motor casing. Therefore, an increase in the noise level results along with an increase in the sound pressure level at a particular frequency according to the shape and the assembling condition (posture) of the motor casing, with the result that the problem caused from the aspect of the noise being generated is not solved.

Further, in the blower apparatus shown in Japanese patent laid-open publication No. 8,638/1994, since the motor casing contacts the end face between the yoke and the end bracket under a large vibration level condition, there is a similar problem to be solved. Also, in the blower apparatus construction where the end bracket of the motor housing is directly screwed to the resin synthetic motor casing using a screw member etc., there is a problem in that the scattering of the noises is increased according to the posture of the motor housing and the tightness of the screw member in the motor housing.

SUMMARY OF THE INVENTION

An object of the present invention is to provide a blower apparatus wherein a low noise characteristic can be obtained.

The above stated object of the present invention can be attained by a blower apparatus which comprises a fan, a blower casing mounting the fan therein, a motor arranged in the blower casing and having a motor flange, and a motor casing disposed between the blower casing and the motor and having a flange portion and a cylindrical shaped housing portion having one end open.

The motor flange of the motor extends in a radial direction of the motor through a distance smaller than the outer diameter of the fan, the motor flange extending from an outer peripheral portion of the motor in the radial direction of the motor.

The flange portion of the motor casing has an outside installing portion and an inside supporting portion, the outside installing portion having a radial dimension which is larger than the outer diameter of the fan and the inside supporting portion having a radial dimension which is smaller than the outer diameter of the fan. The outside installing portion is installed on the blower casing and the inside supporting portion supports the motor flange of the motor.

The housing portion of the motor casing forms a space which establishes a non-contacting condition between an inner peripheral portion of the housing portion of the motor casing and an outer peripheral portion of the motor, except for an existing portion of the motor flange of the motor and the motor housing portion of the motor casing which encloses the motor.

With the above stated blower apparatus construction according to the present invention, the contacting area (hereinafter, the connecting and contacting area) of the connecting portion between the motor and the motor casing, in other words, the motor flange of the motor and the inside supporting portion of the flange portion of the motor casing, can be minimized in size, and also the motor flange is separated from the location where the noise producing brush member is installed.

Further, the outer peripheral portion of the motor is enclosed by the motor casing and a space can be established therebetween so as to establish a non-contacting condition between the motor casing and the motor, except for the connecting portion of the motor flange. Therefore, vibrations are transmitted from the motor to the motor casing only at the minimized connecting portion of the motor flange or the inside supporting portion of the motor casing. The vibration produced in the motor, which is transmitted from the motor to the blower casing through the motor flange and the motor casing, can be restrained to a minimum, and so the noise emitted from the blower apparatus can be reduced. Further, since the space can shield the sliding sounds of the brush member, etc., the harsh sounds emitted thereby can be reduced.

Further, by providing the motor flange on the extension line in the radial direction through the center of gravity of the motor, the moment of the motor weight is not loaded on the motor flange or the inside supporting portion of the motor casing. Therefore, the motor supporting strength of the motor flange and the inside supporting portion of the motor casing can be minimized. Namely, the connecting and contacting area between the motor flange and the inside supporting portion of the motor casing can be made small to satisfy minimum conditions.

Further, by connecting the motor flange to the inside supporting portion of the motor casing through an elastic body, which is fitted into the space between the motor and the motor flange, vibrations are absorbed by the elastic body, and therefore the noise produced by such vibrations can be remarkably reduced.

Further, by employing a sound absorbing member having a particular sound absorbing characteristic in the space formed between the inner peripheral portion of the housing portion of the motor casing and the outer peripheral portion of the motor, a sound pressure level having the particular frequency can be reduced.

According to the present invention, a blower apparatus having a low noise property and a small scattering noise level can be obtained. Further, according to the present invention, a blower apparatus having a light weight, a high assembling property and a high reliability can be obtained.

DESCRIPTION OF THE INVENTION

Hereinafter, one embodiment of a blower apparatus according to the present invention will be explained with reference to the drawings.

Figure 1:
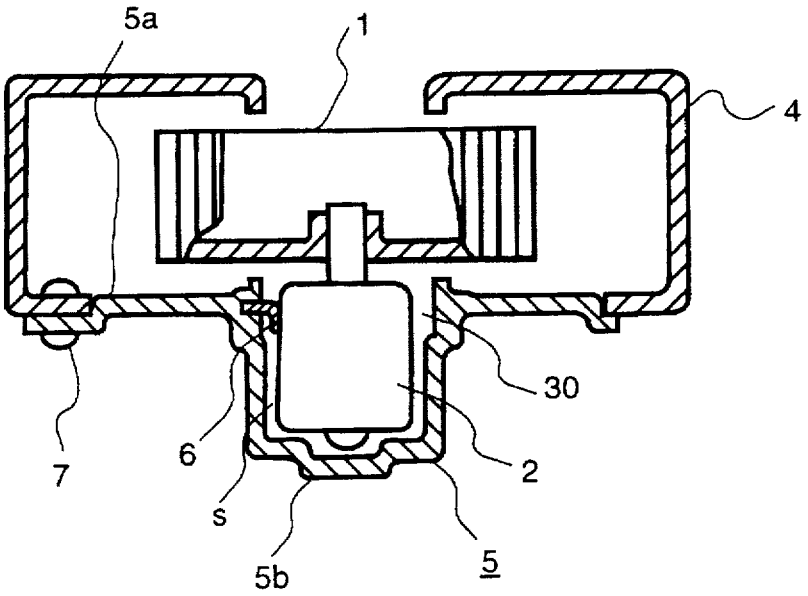
FIG. 1 is a longitudinal cross-sectional view showing one embodiment of a blower apparatus according to the present invention.

FIG. 1 is a longitudinal cross-sectional view showing a blower apparatus according to the present invention. The blower apparatus mainly comprises a fan 1, a motor 2, a blower casing 4, and a motor casing 5.

Namely, in the above blower apparatus, the flat cylindrical shaped blower casing 4 houses the fan 1 in an interior portion thereof. The motor 2 is arranged in a central portion of the motor casing 5 and the fan 1 is secured to a rotating shaft of the motor 2. The motor casing 5 comprises a radially extending outer flange portion **5*a* for mounting to the blower casing 4 and an inside housing portion 5*b* for supporting the motor 2**.

The above stated motor 2 has three motor flanges 6. Each of the three motor flanges 6 are arranged with an equal interval of 120 degrees. Each of these motor flanges 6 is designed to have a radial dimension smaller than the outer diameter of the fan 1. Each motor flange 6 extends from an outer periphery of the motor 2 in a radially outward direction and supports the weight of the motor 2 on the motor casing 5.

Inbetween the three motor flanges 6, three comparatively large clearances 30 are formed between the outer peripheral portion of the motor 2 and an inner peripheral wall of the housing portion **5*b* of the motor casing 5**.

As already indicated, the motor casing 5 is constituted of a flange portion **5*a* and a housing portion 5*b*. The flange portion 5*a* of the motor casing 5 has an outside installing portion having a length in the radial direction which is larger than the outer diameter of the fan 1 and the inside supporting portion of the motor casing 5 has a length in the radial direction which is smaller than the outer diameter of the fan 1. The cylindrical shaped housing portion 5*b* forming a bottom portion of the motor casing 5** has one end which opens only at one side.

The flange portion **5*a* of the motor casing 5 is installed in an opening of the blower casing 4 through a fastening member 7. This flange portion 5*a* of the motor casing 5 supports the motor flange 6 (in other words, the motor 2) through the inside supporting portion of the motor casing 5**.

Further, in this embodiment of the blower apparatus according to the present invention, the housing portion **5*b* of the motor casing 5 surrounds and encloses the motor 2 while establishing a space s therebetween. This space s ensures a non-contacting condition between the inner peripheral portion of the housing portion 5*b* of the motor casing 5** and the outer peripheral portion of the motor 2, except for the existing or installing portion of the motor flange 6.

The above stated embodiment of the blower apparatus illustrated in FIG. 1 according to the present invention is suitable for use in a comparatively compact blower apparatus in which the motor casing 5 is formed as an integral member.

However, a problem in the above stated apparatus illustrated in FIG. 1 is as follows. Namely, due to the presence of the clearances 30 formed between the inner peripheral portion of the housing portion 5*b* of the motor casing 5 and the outer peripheral portion of the motor 2, noises can escape easily through the clearances 30. This defect has been avoided by the embodiment according to the present invention shown in FIG. 2.

Figure 2:
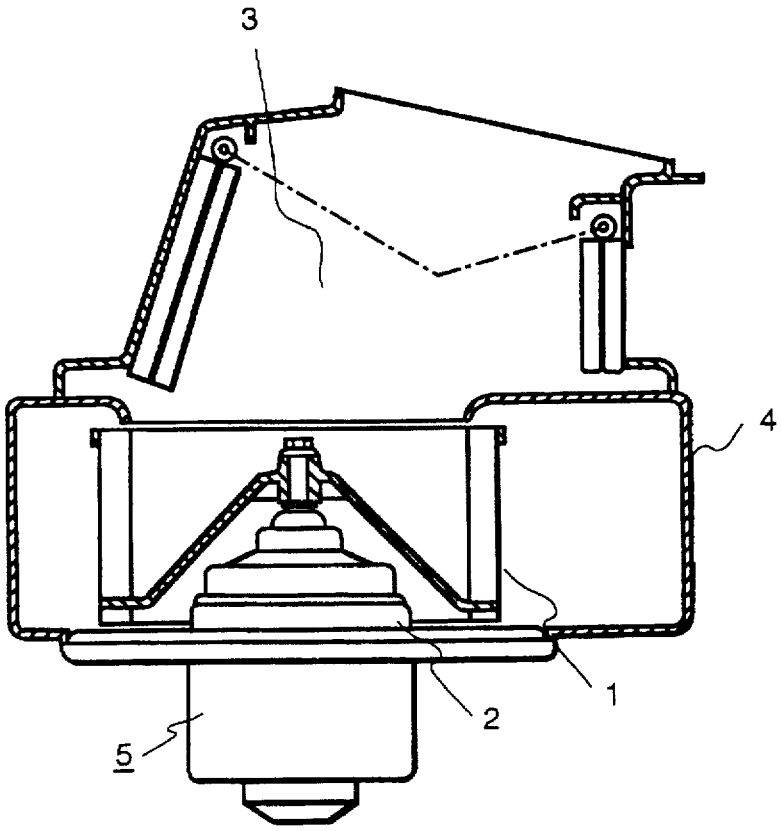
FIG. 2 is a longitudinal cross-sectional view showing another embodiment of a blower apparatus according to the present invention.

FIG. 2 is a longitudinal cross-sectional view showing a blower apparatus according to the present invention. The blower apparatus comprises a fan 1, a motor 2, a change-over box 3 for changing over between inside air and outside air, a blower casing 4, and a motor casing 5.

The fan 1 accommodated in the blower casing 4 is arranged to be secured to the rotating shaft of the motor 2. The motor 2 projects into the blower casing 4 and is supported by the motor casing 5. The blower apparatus performs a ventilating operation. In the ventilating operation, the air is sucked in from the inside air-outside air change-over box 3 in response to rotation of the fan 1 by the motor 2.

Figure 3A:
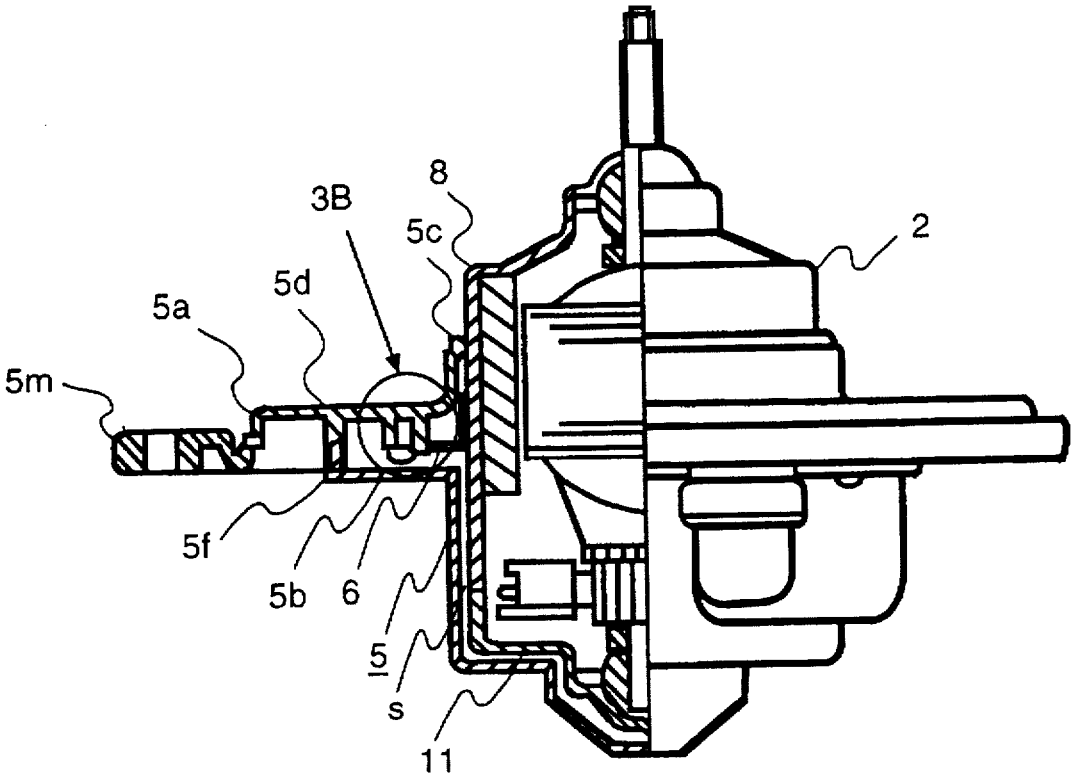
FIG. 3A is a longitudinal cross-sectional view showing a motor portion of the blower apparatus, according to the present invention, shown in the illustrated embodiment of FIG. 2.
Figure 3B:
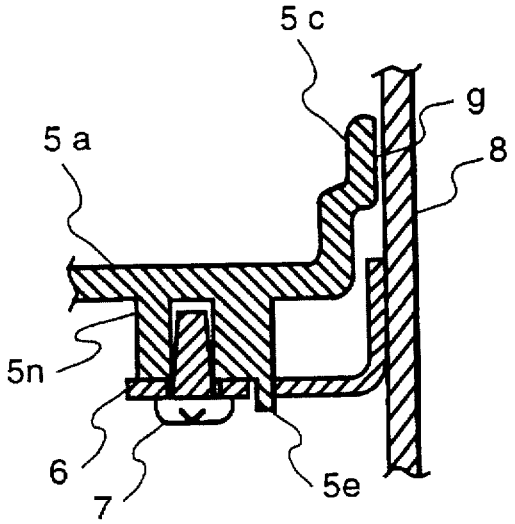
FIG. 3B is an enlarged and partial longitudinal cross-sectional view showing a motor portion of the blower apparatus, according to the present invention, shown in FIG. 3A.

FIG. 3A is a longitudinal cross-sectional view showing a motor portion of the blower apparatus shown in FIG. 2, and FIG. 3B is an enlarged and partial longitudinal cross-sectional view showing the motor portion indicated by a reference numeral 3B in FIG. 3A.

FIGS. 3A and 3B illustrate the portions of the motor 2 and the motor casing 5 which are used as the motor portion of the blower apparatus shown in FIG. 2. The difference in construction between FIGS. 3A and 3B and FIG. 1 is that the motor casing 5 shown in FIGS. 3A and 3B has a divided component construction including a flange portion and a separate housing portion.

Namely, the motor casing 5 comprises a radially extending flange portion 5*a* and a housing portion 5*b* forming a divided construction. The motor housing of the motor 2, having a yoke 8 and an end bracket 11, is completely covered outside of the blower casing 4 by the above stated motor casing 5. In other words, the motor housing surrounds a whole inner face of the upper portion of the motor flange 6.

In order to reduce noise, when the motor housing of the motor 2 is completely covered outside of the blower casing 4 by the motor casing 5, it is effective to divide the motor casing 5 into multiple components from the aspects of productivity and ease of assembling. The flange portion 5*a*; as seen in FIGS. 3A and 3B, comprises a noise-shielding and water-proofing wall 5*c*, a faucet portion 5*d*, a position determining projection member 5*e*, an outside installing portion 5*m* installed on the blower casing 4, and an inside supporting portion 5*n* for connection to the motor flange 6 of the motor 2.

The outside installing portion 5*m* occupies a radial position which is outside of the outer diameter of the fan 1. Besides, the inside supporting portion 5*n* occupies a radial position which is inside the outer diameter of the fan 1. Further, the housing portion 5*b* is formed with a cylindrical shaped construction having an opening portion at one end, and the housing portion 5*b* also has a faucet portion 5*f* for engaging with the faucet portion 5*d* of the flange portion 5*a*.

As seen in enlarged view, as shown in FIG. 3B, one side of the motor flange 6 for supporting the motor weight is fixed to the outer peripheral portion of the yoke 8, which serves as the outer peripheral portion of the motor 2. The other side of the motor flange 6 is extended in the radial direction of the motor 2 from the outer peripheral portion of the motor 2. This other side of the motor flange 6 is connected to the inside supporting portion 5*n* of the flange portion 5*a* of the motor casing 5 by means of the fastener 7.

Further, in this embodiment of the blower apparatus according to the present invention, the flange portion 5*a* and the housing portion 5*b* of the motor casing 5 are connected together by way of the taper-shaped faucet portion 5*d* and the taper-shaped faucet portion 5*f*, respectively. The flange portion 5*a* and the housing portion 5*b* of the motor casing 5 are connected using the fastener 7. The housing portion 5*b* of the motor casing 5 surrounds and encloses the motor 2 while providing a space s therebetween. This space s forms the non-contacting area between an inner peripheral portion of the housing portion 5*b* of the motor casing 5 and the outer peripheral portion of the motor 2, except for the existing parts required for installing the motor in the form of the flange 6.

Hereinafter, a detailed description of the motor construction according to the present invention will be explained with reference to FIGS. 3A and 3B and FIGS. 4A and 4B.

Figure 4A:
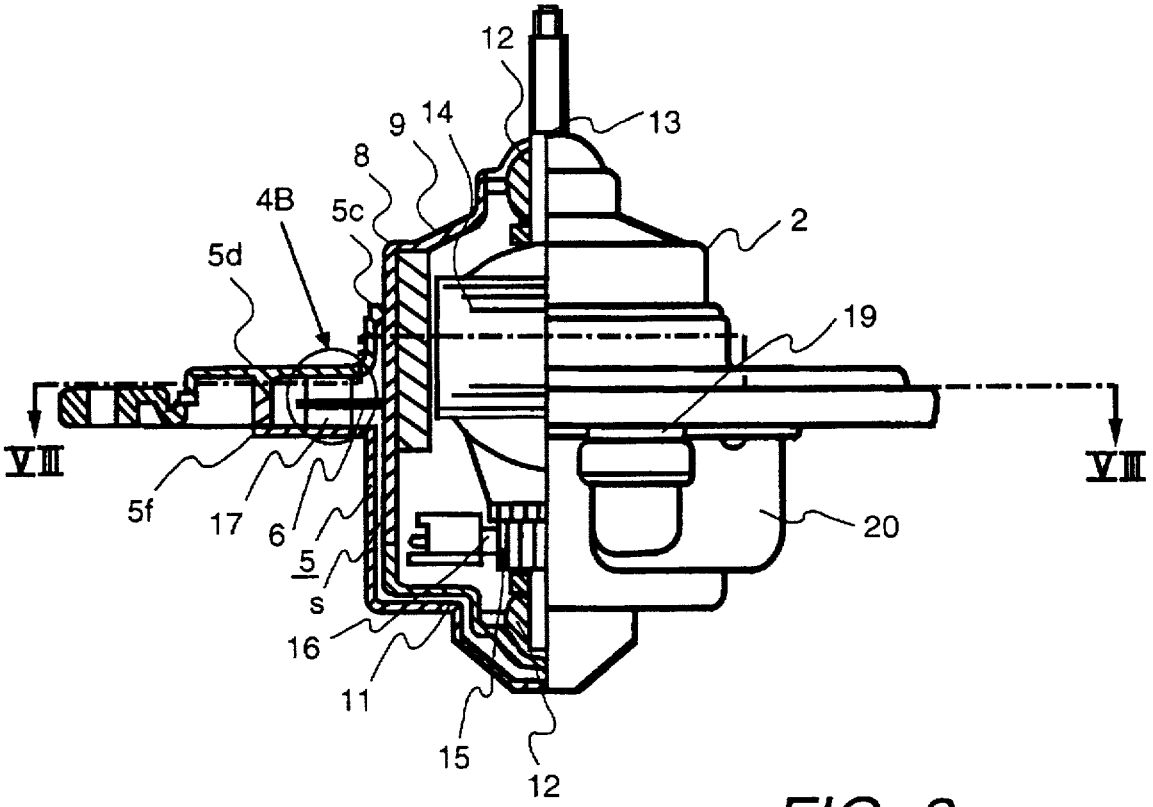
FIG. 4A is a longitudinal cross-sectional view showing a motor portion of the blower apparatus according to the present invention.
Figure 4B:
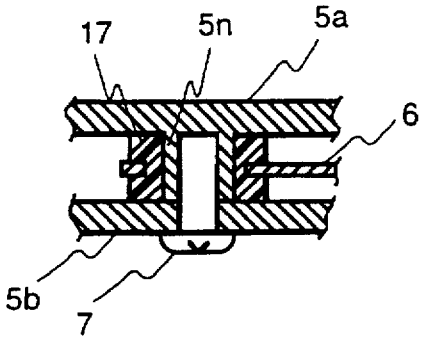
FIG. 4B is an enlarged and partial longitudinal cross-sectional view showing a motor portion of the blower apparatus, according to the present invention, shown in FIG. 4A.

FIG. 4A is a longitudinal cross-sectional view showing another embodiment of a motor portion of a blower apparatus according to the present invention, and FIG. 4B is an enlarged and partial longitudinal cross-sectional view showing the elements within the area indicated by reference numeral 4B in FIG. 4A.

An interior portion of the motor 2 includes a stator 9 arranged inside of the yoke 8. One end of the yoke 8 is opened and the end bracket 11 is installed to engage this opening portion of the yoke 8. Two oil impregnation sliding bearing members 12 are concentrically assembled at opposite ends with respect to each other in the yoke 8 and the end bracket 11, respectively.

A rotor shaft 13 is supported by the oil impregnation slide bearing members 12. A rotor 14 and a commutator 15 are installed, respectively, on the rotor shaft 13. A brush member 16 is installed on the end bracket 11. The motor flange 6 is fixed to the outside of the yoke 8, for example, using a spot welding process. The motor flange 6 also can be provided as a ring which is inserted under pressure and supported using its elastic properties.

As provided in the embodiment shown in FIG. 3B, the interior portion of the flange portion 5*a* has a cylindrical construction where a fan installing side of the motor 2 projects. The opening in the flange portion 5*a* where the motor is supported is formed by the cylindrical shaped noise-shielding and water-proofing wall 5*c*. This noise-shielding and water-proofing wall 5*c* establishes a gap g where the fan installing side of the yoke 8 of the motor 2 is spaced from and covered by the flange portion 5*a*.

When the motor casing 5 is divided from an aspect of the ease of assembling etc., the noise-shielding function of the noise-shielding and water-proofing wall 5*c* represents a housing portion which plays an important role in noise reduction. Namely, the noise-shielding and water-proofing wall 5*c* has a hung shaped construction and is arranged close to the outer peripheral portion of the yoke 8 as shown in FIG. 3B.

In accordance with the present invention, the above stated close condition (where the noise-shielding and water-proofing wall 5c does not contact the outer peripheral portion of the yoke 8, but seems to contact the outer peripheral portion of the yoke 8) has an important purpose. In this regard, if the noise-shielding and water-proofing wall 5c were to contact the outer peripheral portion of the yoke 8 (the contacting condition), this contacting condition would allow vibrations to be transmitted through the contacting elements; conversely, if the gap were to have an excessive spacing, noise leakage would occur, with the result that it would be impossible to attain noise reduction.

In order to establish the above stated close condition, it is effective to divide the motor casing 5 from the point of view of productivity and ease of assembling. Accordingly, for solving the above stated problems in the embodiment shown in FIG. 1 use is made of the noise-shielding and water-proofing wall 5c. In other words, for completely shielding the noises which leak from the clearances 30 formed at the side of the fan 1 between the inner peripheral portion of the housing portion 5b and the outer peripheral portion of the motor 2, the noise-shielding and water-proofing wall 5c is provided. A detailed construction of this noise-shielding and water-proofing wall 5c will be explained later.

Further, in this embodiment of the blower apparatus according to the present invention, the housing portion 5b of the motor casing 5 surrounds and encloses a portion of the motor 2 by establishing the space s. This space s forms a non-contacting condition between the inner peripheral portion of the housing portion 5b of the motor casing 5 and the outer peripheral portion of the motor 2, except for the existing or installing portion of the motor flange 6.

In the above stated blower apparatus construction, the motor casing 5 is constituted by the flange portion 5a and the housing portion 5b. The housing portion 5b of the motor casing 5 provides the space s for establishing the non-contacting condition with the outer peripheral portion of the motor 2. The flange portion 5a of the motor casing 5 has a cylindrical noise-shielding and water-proofing wall 5c for enclosing the motor 2.

Further, by the provision of the above stated noise-shielding and water-proofing wall 5c as part of the flange portion 5a, noise which has previously leaked from the clearances 30 between the motor 2 and the motor casing 5 are completely shielded, and at the same time the flange portion 5a and the noise-shielding and water-proofing wall 5c are integrally formed. Therefore, the wall 5c can serve as a noise-shield and also as a water-proof barrier, so that it is unnecessary to provide a separate water-proofing air sealing member, as provided on the conventional blower apparatus.

Besides, in the conventional blower apparatus, the motor with the fan is directly installed on the blower casing. Therefore, the dimension of the motor flange in the radial direction for supporting the motor is inevitably larger than the outer diameter of the fan.

In contrast to the above, according to the construction of the above stated embodiments of the present invention, since the motor 2 is installed on the blower casing 4 through the motor casing 5, it is possible to determine the dimension of the motor flange 6 in the radial direction for installing the motor 2 to the motor casing 5 so that it is smaller than the outer diameter of the fan 1.

Namely, since the motor casing 5 is provided between the motor 2 and the blower casing 4, the motor 2 can be connected to the motor casing 5 in advance by way of the motor flange 6 and the inside supporting portion 5n of the flange portion 5a of the motor casing 5. The motor flange 6 is designed to have a radial dimension which is smaller than the outer diameter of the fan 1. Then, through the outside installing portion 5m having a radial dimension larger than the outer diameter of the fan 1, it is possible to install the motor casing 5 for mounting the motor 2 on the blower casing 4. As a result of this construction, it is possible to reduce the radial dimension of the motor flange 6, which extends from the outer peripheral portion of the yoke 8 in the same radial direction of the motor 2 as the flange portion 5a.

Since the radial dimension of the motor flange 6 is made smaller, the connecting and contacting area can be made small, and a light weight blower apparatus having a metallic motor flange can be attained. Further, since the radial dimension of the motor flange 6 is made smaller, it is possible to employ a resin material for the motor flange, so that an even more light weight blower apparatus construction having a resin motor flange can be attained.

Also, from the aspect of manufacturing, it is desirable to make the flange portion 5a and the housing portion 5b of the motor casing 5 using a resin material. So as to facilitate assembly and disassembly of the motor 2 from the blower casing 4, the motor flange 5 is connected to the flange portion 5a of the motor casing 5 through use of the fastener 7.

Further, the length in the radial direction of the motor flange 6 for extending over from the outer peripheral portion of the yoke 8 toward the motor is made small, so that the connecting and contacting area between the motor flange 6 and the inside supporting portion 5n of the flange portion 5a of the motor casing 5 can be set to a necessary minimum area to provide for necessary support of the motor weight. Therefore, the vibration transmitting portion in the blower apparatus can be minimized, and so an improved noise reduction in the blower apparatus can be attained.

Figure 8:
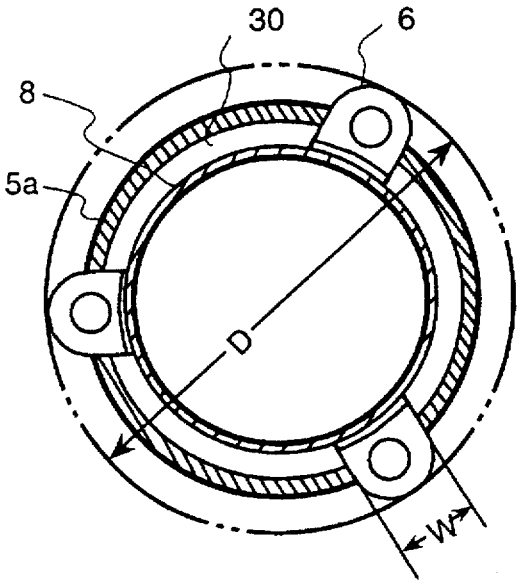
FIG. 8 is a cross-sectional view taken along line XIII—XIII of FIG. 4A.

In general, in order to minimize the connecting and contacting area between the motor flange 6 and the inside supporting portion 5n of the motor casing 5, for example, the construction of the motor flange 6 is divided into three pieces, like as a tripod. FIG. 8 is a cross-sectional view showing a cross-section taken along to a line XIII—XIII of FIG. 4A. However, in FIG. 8 cross-sectional portions such as the interior portion of the motor are omitted because they do not require further explanation.

As shown in FIG. 8, since the motor flange 6 is provided as three pieces, both the width (W) of the motor flange 6 and the width (W) of the inside supporting portion 5n of the motor casing 5 are made small. Therefore, it is possible to minimize the connecting and contacting area between the motor flange 6 and the inside supporting portion 5n of the motor casing 5.

However, according to the configuration of the motor flange 6 as shown in FIG. 8, three comparatively large clearances 30 are formed between the outer peripheral portion of the yoke 8 and the inner peripheral portion of the flange portion 5a of the motor casing 5. In order to completely block the clearances 30 to prevent passage of water and to provide a noise shield, as stated above, the noise-shielding and the water-proofing wall 5c is provided close to the outer peripheral portion of the yoke 8. Therefore, a low noise property in the blower apparatus can be attained.

As shown in FIG. 8, it is desirable to use the same dimensions with respect to the radial dimension (D) of the motor flange 6 and the width dimension (W) of the inside supporting portion 5n of the motor casing 5 from the aspects of minimized design and economical design.

In the case of a divided motor casing 5, the housing portion 5b of the motor casing 5 and the noise-shielding and water-proofing wall 5c form a housing portion for completely covering the outer peripheral portion of the motor 2 outside of the blower casing 4. Except for the existing or installing portion of the motor flange 6, the space s for establishing the non-contacting condition is formed between the inner peripheral portion of the housing portion 5b of the motor casing 5 and the outer peripheral portion of the motor 2. The above housing portion inner peripheral portion is comprised of the housing portion 5b of the motor casing 5 and the noise-shielding and water-proofing wall 5c of the motor casing 5. Thus, the motor 2 is enclosed by the divided motor casing 5.

Further, it is desirable to provide the motor flange 6, which is positioned at the outer peripheral portion of the yoke 8, at a predetermined position which exists on an extension line in the motor radial direction of the center of gravity of the motor 2. More specifically the direction of the contacting face of the contacting portion between the motor flange 6 and the inside supporting portion 5n of the flange portion 5a may extend toward the extension line in the motor radial direction of the center of gravity of the motor 2.

With the above stated blower apparatus construction, since the moment of the motor weight is not loaded on the motor flange 6 for supporting the motor 2, the design strength of the motor flange 6 can be minimized. Namely, both the radial direction dimension (D) of the motor flange 6 and the width dimension (W) of the inside supporting portion 5n of the motor casing 5 can be minimized. Therefore, the connecting and contacting area between the motor flange 6 and the inside supporting portion 5n of the flange portion 5a can be minimized.

In the conventional blower apparatus, the supporting means supports the motor in the motor axial direction through the motor casing for shielding the noises. Namely, the motor supporting means is provided on a rear portion side of the motor (the side of the end bracket shown in FIG. 3A). Therefore, the motor supporting means comprises a cantilever support system where the moment of the motor weight is loaded on the motor supporting means and the requirement for rigidity of the motor supporting means becomes high. Accordingly, since the rigidity of the motor supporting means is high, and so the connecting and contacting area becomes large, and so the motor vibration is easily transmitted to the motor casing from the motor supporting means, whereby the noises become large. Further, since the motor supporting means is provided on the rear portion of the motor, the surface area of the motor casing where the motor vibration is transmitted becomes large, so that the motor casing becomes a resonance body and the noise level is heightened.

At the end bracket side of the motor, a brush member is provided and this brush member forms the largest vibration portion in the motor. As shown in the above stated embodiments according to the present invention, the motor supporting means (the motor flange 6) is provided on the position which corresponds to the extension line in the motor radial direction of the center of gravity of the motor. Since the motor supporting means is separated from the brush member existing or installing portion, it is effective to provide a low noise blower apparatus construction in comparison with the conventional blower apparatus.

Further, according to the above stated embodiments according to the present invention, the housing portion 5b of the motor casing 5 has a cylindrical construction with the bottom portion having an end opening portion on one side. The housing portion 5b of the motor casing 5 forms an enclosing space on the opposite side of the fan 1 (an opposite side of the installation of the fan 1); in other words, this housing portion 5b of the motor casing 5 forms a covering for the end bracket 11.

The faucet portions 5d and 5f are provided at the fit-in portion between the flange portion 5a and the housing portion 5b. The flange portion 5a and the housing portion 5b of the motor casing 5 are faucet-fitted so as to cover the outer peripheral portion of the motor 2 under the non-contacting condition. Namely, the space s establishes the non-contacting condition between the motor 2 and the motor casing 5 and thereby an effective noise reduction in the blower apparatus can be attained. At the same time, the space s makes it possible to arrange a noise absorbing member between the outer peripheral portion of the motor housing and the inner peripheral portion of the housing portion, as will be described later.

A motor cooling air intake port 19 for the motor 2 is integrally formed on the flange portion 5a. Further, a motor cooling air introducing passage 20 for the motor 2 is integrally formed on the cylindrical portion of the housing portion 5b. Since the motor cooling air intake port 19 is integrally formed on the flange portion 5a, the motor casing 5 can serve as the motor cooling air intake port 19, and so it is unnecessary to provide a separate air intake port exclusively for this purpose, as provided in the conventional blower apparatus.

Further, since the motor cooling air introducing passage 20 is integrally formed on the cylindrical portion of the housing portion 5b, the motor casing 5 serves as the motor cooling air introducing passage 20, and so it is also unnecessary to provide a cooling pipe as in the conventional blower apparatus. In addition, since the motor casing 5 completely covers the whole motor housing outside of the fan casing 4, the motor 2 can be fully cooled by the cooling air from the motor cooling air introducing passage 20. In case of the embodiment according to the present invention illustrated in FIG. 1, a motor cooling air intake port 19 or a motor cooling air introducing passage 20 may be provided at the existing or installing portion of the housing portion 5b of the motor casing 5.

With the above stated blower apparatus constructions according to the present invention, it is possible to obtain noise reduction in the blower apparatus by the following operations.

Namely, the connecting and contacting area between the motor flange and the motor casing can be minimized and at the same time the motor flange can be separated from the brush member existing or installing portion, so that the vibration of the motor, which is transmitted from the motor (namely, the motor housing) to the blower casing via the motor casing (namely, the flange portion or the housing portion) through the motor flange, can be reduced to a minimum.

Both the flange portion and the housing portion, which form the motor casing, enclose the outer peripheral portion of the motor housing and, between the motor housing, namely between the motor casing and the motor, the space s can be formed. This space s establishes a non-contacting condition between the parts, except for the supporting portion of the motor flange for supporting the motor. As a result, since the vibration transmitting portion from the motor to the motor casing exists only on the supporting portion of the motor flange where the above stated connecting and contacting area is minimized, any vibrations which are transmitted can be reduced, and so the noise in the blower apparatus can be reduced.

Further, by additional insertion of an elastic body or insertion of a noise-absorbing member, the noise in the blower apparatus can be further reduced. More particularly, by completely shielding the brush member, sliding sounds, which are a factor of the noise scattering etc., it is possible to prevent the noise from leaking to the outside, and so a reduction of the scattering of the noise level in the blower apparatus can be attained.

Further, the overall weight in the blower apparatus can be reduced and a high ease of assembling the blower apparatus can be obtained, and therefore a blower apparatus having a high reliability can be provided.

The method of connecting the motor flange 6 and the inside supporting portion 5*n* of the motor casing 5 shown in the illustrated embodiment of FIG. 3 will now be described. Namely, the motor flange 6 is connected to flange portion 5*a* of the motor casing 5 through use of a fastener 7. In this case, the positioning determining projection member 5*e* for positioning the motor flange 6 is formed on the installing face of the inside supporting portion 5*n* of the motor casing 5, as seen in FIG. 3B.

Further, the invention may employ another connecting method as shown in FIGS. 4A and 4B. Namely, in the connection method shown in FIGS. 4A and 4B, in order to connect the motor flange 6 to the flange portion 5*a* via the inside supporting portion 5*n* and the housing portion 5*b*, the elastic body 17 fitted into the motor flange 6 is inserted between the flange portion 5*a* and the housing portion 5*b* of the motor casing 5. Then, the flange portion 5*a* and the housing portion 5*b* of the motor casing 5 are secured together using the fastener 7. Namely, the inside supporting portion 5*n* of the motor casing 5 is connected to the motor flange 6 through the elastic body 17 fitted into the opening in the motor flange 6.

With the above stated construction, the vibration, being the main factor of the generation of noises, is absorbed by the elastic body 17 fitted into the motor flange 6, and therefore the noise reduction in the blower apparatus can be further attained. As the elastic body 17, for example, a natural rubber member or a synthetic rubber member can be employed. In some cases, a belt shaped plate spring member or a coil shaped spring member can be employed.

Figure 5A:
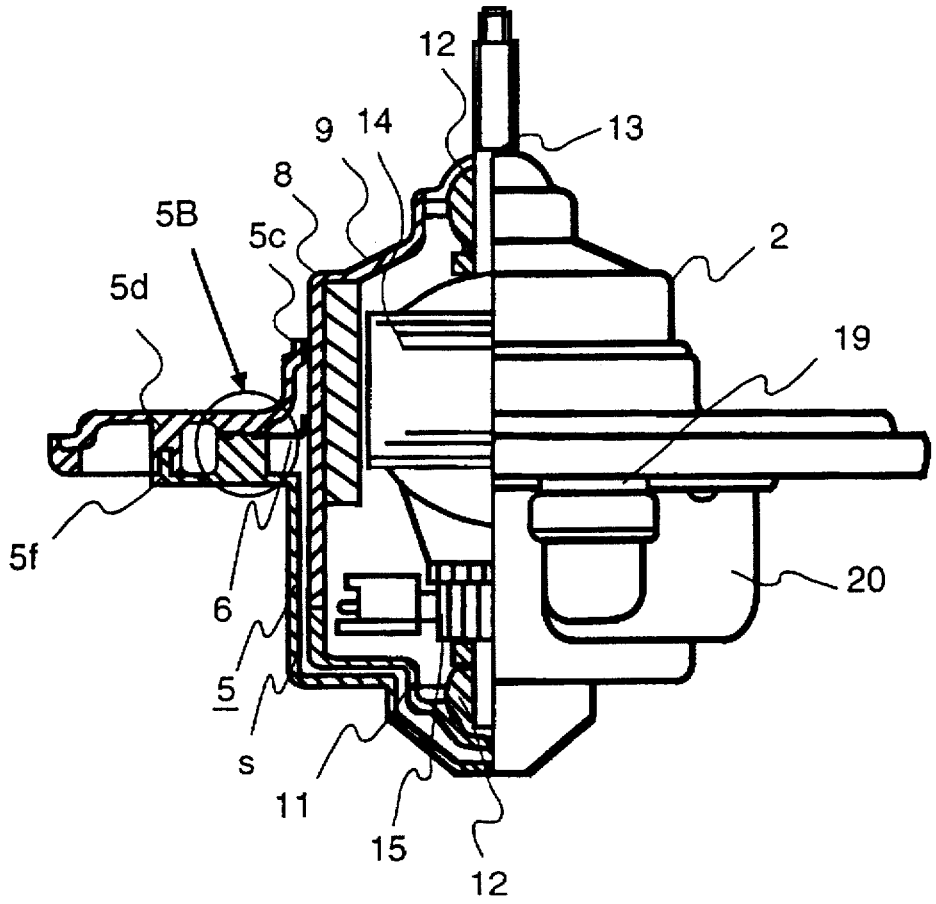
FIG. 5A is a longitudinal cross-sectional view showing a motor portion of the blower apparatus according to the present invention.
Figure 5B:
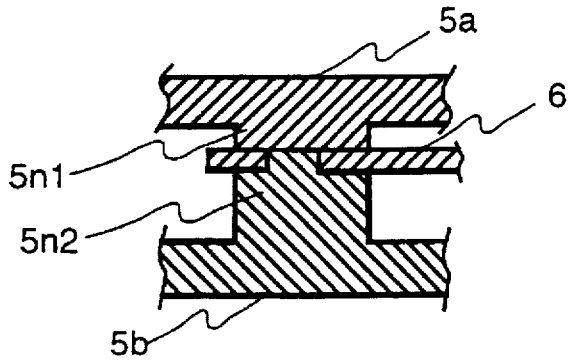
FIG. 5B is an enlarged and partial longitudinal cross-sectional view showing a motor portion of the blower apparatus, according to the present invention, shown in FIG. 5A.

FIG. 5A is a longitudinal cross-sectional view showing another motor portion of a blower apparatus representing a further embodiment according to the present invention, and FIG. 5B is an enlarged and partial longitudinal cross-sectional view showing the motor portion indicated by a reference numeral 5B in FIG. 5A.

Namely, the embodiment employing another connecting method is shown in FIGS. 5A and 5B. In the connecting method shown in FIGS. 5A and 5B, the motor flange 6 extending from the outer diameter portion of the yoke 8 is sandwiched by the flange portion 5*a* serving as a divided flange part and the housing portion serving as a divided housing part. For example, by welding the contacting face between the flange portion 5*a* and the housing portion 5*b* of the motor casing 5, the inside supporting portions 5*n*1 and 5*n*2 of the motor casing 5 and the motor flange 6 are connected, so that the motor 2 is supported without the need for the fastener 7 of the previous embodiment. In this case, since it is unnecessary to provide the fastener, the number of components can be reduced, thereby reducing the cost.

Further, in this embodiment of the blower apparatus according to the present invention, the housing portion 5*b* of the motor casing 5 surrounds and encloses the motor 2 by provision of the space s. This space s establishes a non-contacting condition between an inner peripheral portion of the housing portion 5*b* of the motor casing 5 and the outer peripheral portion of the motor 2, except for the existing or installing portion of the motor flange 6.

Figure 6:
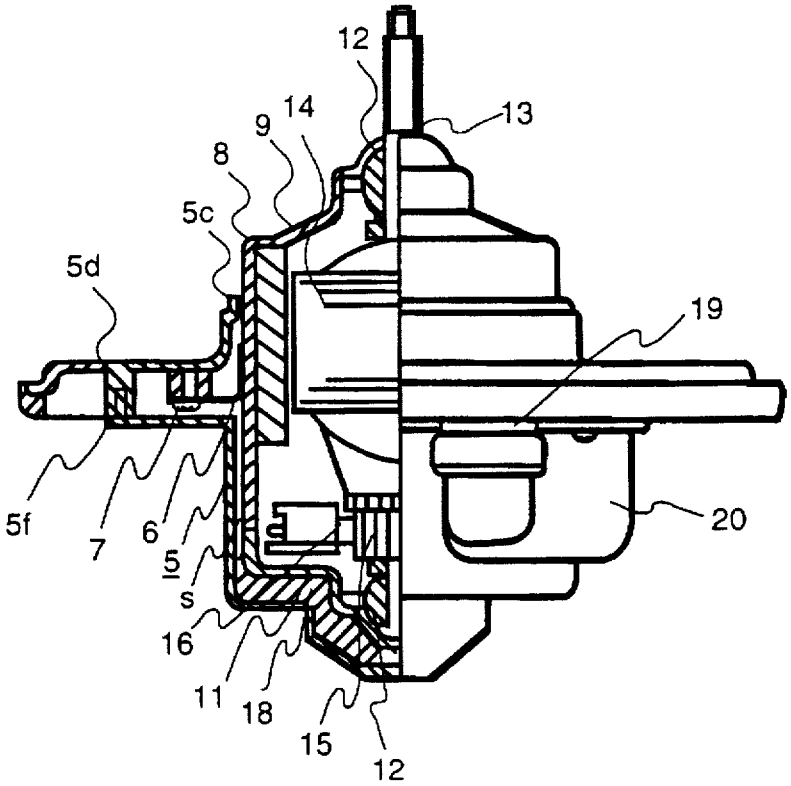
FIG. 6 is a longitudinal cross-sectional view showing a motor portion of the blower apparatus according to the present invention.

FIG. 6 is a longitudinal cross-sectional view showing another motor portion of a blower apparatus representing a further embodiment according to the present invention. In this embodiment shown in FIG. 6, a sound adsorbing body 18 is arranged in the space s between the inner peripheral portion of the housing portion 5*b* of the motor casing 5 and the outer peripheral porion of the motor 2, so that noise can be reduced. In this case, when the housing portion 5*b* of the motor casing 5 is formed so as to be removable, then the sound absorbing body 18 can be easily disposed in the spaces. Namely, it is desirable to design the construction in such a way that the installation and the replacement of the sound absorbing body 18 can be easily carried out.

With the above stated blower apparatus construction, since a sound absorbing body 18 having a predetermined sound absorbing characteristic corresponding to the natural noise characteristic of the motor 2 can be selected, it is possible to take specific countermeasures to eliminate noise of a particular narrow frequency.

In the embodiment of the blower apparatus shown in FIG. 6, the sound absorbing body 18 is arranged in the space which is formed on the opposite side of the motor from the fan (opposite the installing side of the fan), since generally the brush member, which is the main source of the noise, is positioned at the opposite side of the motor from the fan. In the case where the brush member is positioned on the same side of the motor as the fan, the absorbing body 18 is arranged in the space on that side of the motor.

It is not essential to locate the sound absorbing material with respect to the position of the brush member, however it is desirable to arrange the sound absorbing body 18 in the space s at a position near the noise generating source. Namely, the sound absorbing body having a predetermined sound-absorbing characteristic should be provided in the space s between the motor and the motor casing where it will be effective to absorb any sound being generated.

Further, in this embodiment of the blower apparatus according to the present invention, the housing portion 5*b* of the motor casing 5 surrounds and encloses the motor 2 with a spacing which forms the space s. This space s establishes the non-contacting condition between the inner peripheral portion of the housing portion 5*b* of the motor casing 5 and the outer peripheral portion of the motor 2, except for the existing or installing portion of the motor flange 6.

Figure 7:
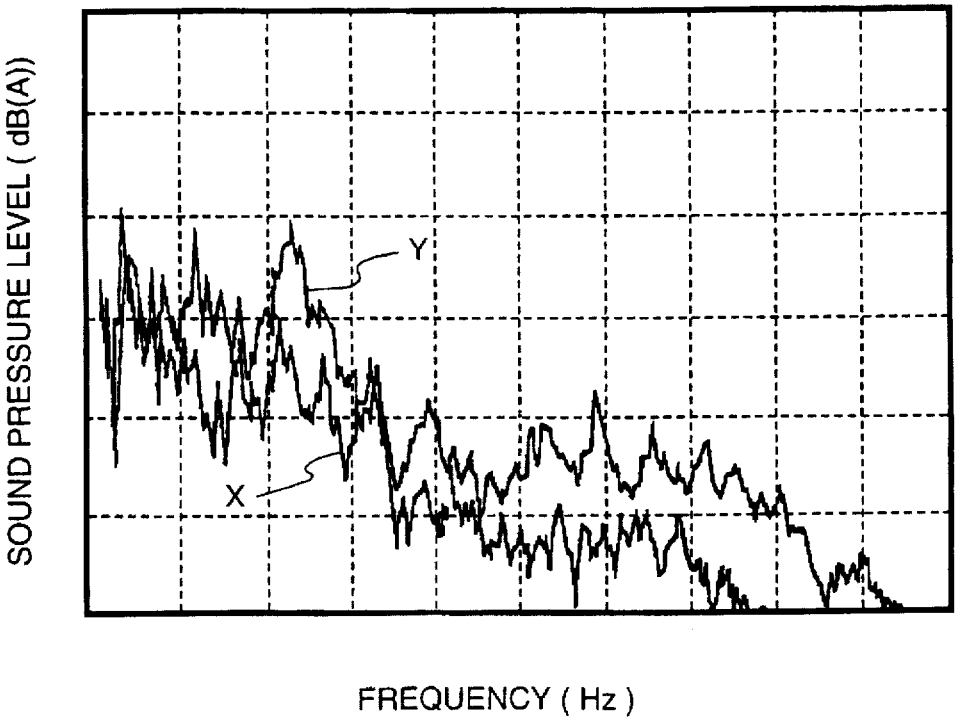
FIG. 7 is a frequency-sound characteristic diagram showing a low noise effect of a blower apparatus according to the present invention.

FIG. 7 is a frequency analyzing diagram showing the low noise effect of the blower apparatus according to the present invention. From the experimentation carried out by the inventors of the present invention, as shown in FIG. 7, in the blower apparatus construction represented by a curve X according to the present invention compared with a conventional blower apparatus construction represented by a curve Y, it was confirmed that the sound pressure level produced by the present invention is low and extends over a wide frequency area. In particular, the sound area represented by a frequency of 4–5 kHz exhibits a decrease of 2 dB(A).

What is claimed is:

1. A blower apparatus comprising:

a fan;

a blower casing for mounting said fan therein;

a motor arranged in said blower casing and having a motor flange secured thereto; and a motor casing disposed between said blower casing and said motor and having a flange portion and a cylindrical shaped motor housing portion having one end opened; wherein said motor flange of said motor has a dimension in the radial direction of the motor which is smaller than the outer diameter of said fan, said motor flange extending from an outer peripheral portion of said motor in the radial direction of said motor;

said flange portion of said motor casing has an outside installing portion and an inside supporting portion;

said outside installing portion has a dimension in the radial direction of said motor which is larger than said outer diameter of said fan and said inside supporting portion has a dimension in the radial direction of said motor which is smaller than said outer diameter of said fan;

said outside installing portion is installed on said blower casing and said inside supporting portion supports said motor flange of said motor; and said motor housing portion of said motor casing forms a space which establishes a non-contacting condition between an inner peripheral portion of said motor housing portion of said motor casing and an outer peripheral portion of said motor, except for where said motor flange of said motor is located, so that said motor housing portion of said motor casing encloses said motor.

2. A blower apparatus according to claim 1, wherein:

said motor flange of said motor is provided on an extension line in said radial direction of said motor of the center of gravity of said motor.

3. A blower apparatus according to claim 1, wherein:

said inside supporting portion of said flange portion of said motor casing is connected to said motor flange of said motor through an elastic body which is fitted into said motor flange of said motor.

4. A blower apparatus according to claim 1, wherein:

a sound absorbing material having a particular sound absorbing characteristic is provided in said space formed between said inner peripheral portion of said motor housing portion of said motor casing and said outer peripheral portion of said motor.

5. A blower apparatus comprising:

a fan;

a blower casing for mounting said fan therein;

a motor arranged in said blower casing and having a motor flange secured thereto; and a motor casing disposed between said blower casing and said motor and having a flange portion and a cylindrical shaped motor housing portion having one end opened; wherein said flange portion and said motor housing portion of said motor casing are formed as divided elements;

said motor flange of said motor has a dimension in the radial direction of the motor which is smaller than the outer diameter of said fan, said motor flange extending from an outer peripheral portion of said motor in the radial direction of said motor;

said flange portion of said motor casing has an outside installing portion and an inside supporting portion;

said outside installing portion has a dimension in the radial direction of said motor which is larger than said outer diameter of said fan and said inside supporting portion has a dimension in the radial direction of said motor which is smaller than said outer diameter of said fan;

said outside installing portion is installed on said blower casing and said inside supporting portion supports said motor flange of said motor;

said flange portion of said motor casing has a cylindrical shaped sound shielding and water-proofing wall in closely-spaced relationship with a wall of said motor; and said motor housing portion of said motor casing forms a space which establishes a non-contacting condition between an inner peripheral portion of said motor housing portion of said motor casing and an outer peripheral portion of said motor, except where said motor flange of said motor is located, so that said motor housing portion of said motor casing encloses said motor.

6. A blower apparatus according to claim 5, wherein:

said flange portion of said motor casing and said other housing portion of said motor casing sandwich said motor flange of said motor; and said flange portion of said motor casing and said motor housing portion of said motor casing are welded together;

thereby said motor flange of said motor is supported.

7. A blower apparatus according to claim 5, wherein:

said flange portion of said motor casing has a cooling air intake port for said motor, said motor cooling air intake port being integrally formed in said flange portion of said motor casing.

8. A blower apparatus according to claim 5, wherein:

said motor housing portion of said motor casing has a cooling air introducing port for said motor, said motor cooling air introducing port being integrally formed in said motor housing portion of said motor casing.

9. A blower apparatus according to claim 5, wherein:

wherein said flange portion of said motor casing and said motor housing portion of said motor casing are joined by a taper-shaped portion provided on said flange portion and a reciprocally taper-shaped portion provided on said motor housing portion of said motor casing.

* * * * *